US005518316A

United States Patent [19]

Kristola

[11] Patent Number: 5,518,316

[45] Date of Patent: May 21, 1996

[54] HEAT SEALED BAG

[75] Inventor: Jay L. Kristola, Kiel, Wis.

[73] Assignee: H. G. Weber and Company, Inc., Kiel, Wis.

[21] Appl. No.: 249,226

[22] Filed: May 25, 1994

[51] Int. Cl.[6] ..... B65D 30/12

[52] U.S. Cl. ..... 383/126

[58] Field of Search ..... 383/126, 125

[56] References Cited

U.S. PATENT DOCUMENTS

| | | | |
|---|---|---|---|
| 333,523 | 1/1886 | Honiss . | |
| 388,614 | 8/1888 | Appel . | |
| 2,059,200 | 11/1936 | Bancroft . | |
| 2,078,467 | 4/1937 | Sterling . | |
| 2,353,605 | 7/1944 | Waters | 383/126 |
| 2,444,762 | 7/1948 | Waters | 383/126 X |
| 2,496,796 | 2/1950 | Kardon . | |
| 2,777,368 | 1/1957 | Koop . | |
| 3,237,534 | 3/1966 | Lissner . | |
| 3,342,402 | 9/1967 | Kardon . | |
| 3,397,622 | 8/1968 | Goodwin . | |
| 3,734,395 | 5/1973 | Erk et al. . | |
| 4,490,131 | 12/1984 | Coleman et al. . | |

FOREIGN PATENT DOCUMENTS

| | | | |
|---|---|---|---|
| 688088 | 6/1964 | Canada | 383/125 |
| 1175846 | 4/1959 | France . | |
| 1188379 | 9/1959 | France | 383/125 |
| 2393673 | 1/1979 | France . | |

*Primary Examiner*—Jes F. Pascua
*Attorney, Agent, or Firm*—Hill, Steadman & Simpson

[57] ABSTRACT

A self-opening style bag formed from a paper tube of rectangular configuration wherein portions of the side walls are folded inward to form a bottom and thereafter are surrounded by folded over portions of the front and rear walls to complete the bottom. Front and rear flaps are cut into the front and rear panels and adhesive is applied to inside surfaces of the front and rear walls in a C-shaped configuration around said flaps, folding the side walls and portions of the front and rear walls inwardly forms a seal across the width of the bottom along the front and rear walls and a seam is formed between the folded over portion of the side panels which completes a sealed integrity of the bottom of the bag.

5 Claims, 3 Drawing Sheets

FIG. 1
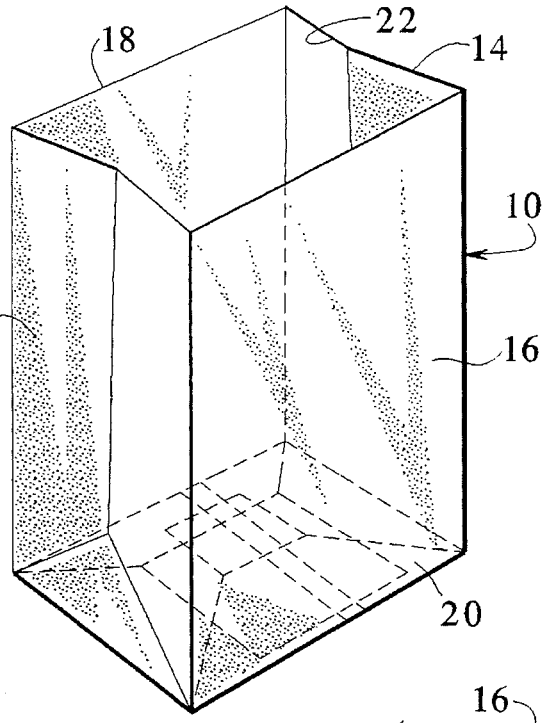
FIG. 7
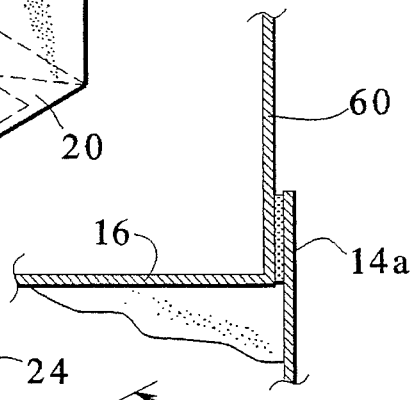
FIG. 2
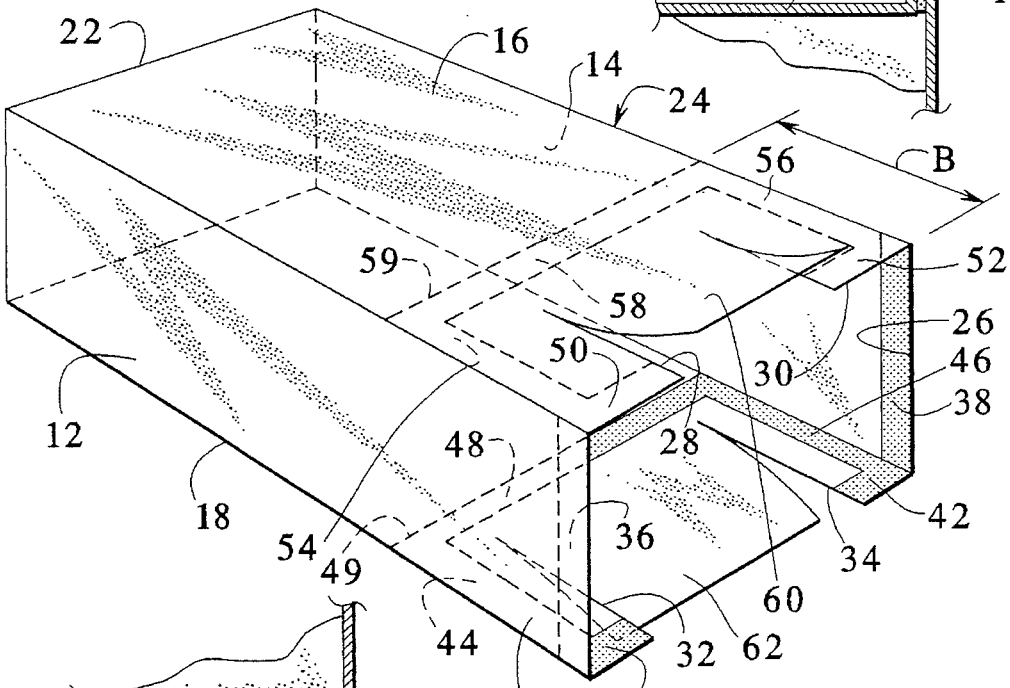
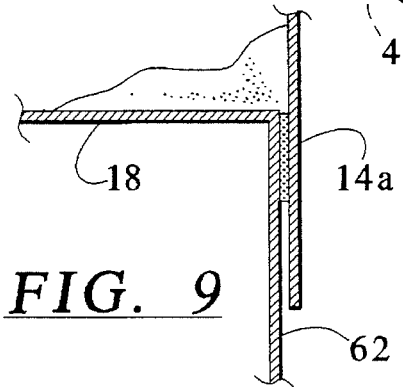
FIG. 9
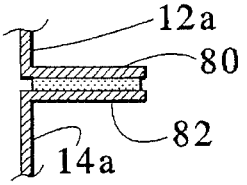
FIG. 8

FIG. 5
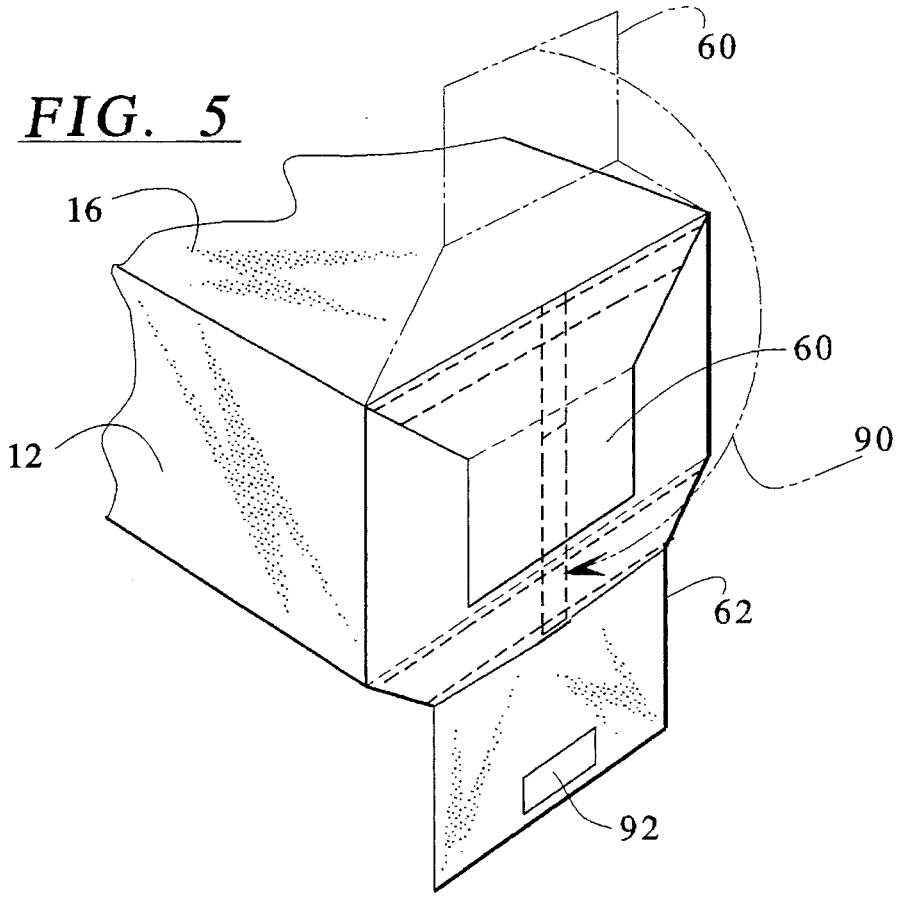
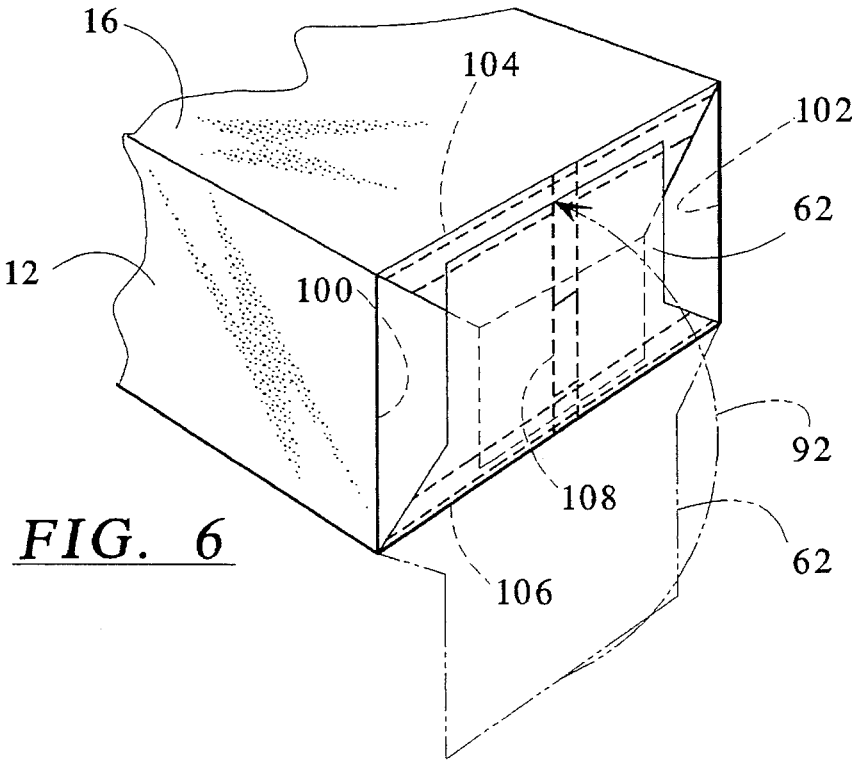
FIG. 6

HEAT SEALED BAG

BACKGROUND OF THE INVENTION

The present invention relates to bags. More specifically, the present invention relates to self-opening style or self-opening square bags, referred to in the industry as SOS bags. This type of bag has a folded bottom, and is typically used for grocery sacks, lunch sacks, microwave popcorn sacks and other bags which are required to stand on their own when opened. Such SOS bags are disclosed in U.S. Pat. No. 3,669,347 and U.S. Pat. No. 3,606,822.

Tubular sacks with gussetted sides are known. Because the bottom of such a bag is folded, the interior of the bag has folded-over flaps. Unfortunately, small objects within the bag can become trapped under the flaps, making them difficult to retrieve.

It is known to apply an adhesive to the inside of a tubular bag to form the square bottom. However, the adhesive in prior art bags has not been effectively placed so that the bottom flaps are adequately secured. Some prior art configurations secure interior flaps by gluing an insert strip over certain flap edges. For example, U.S. Pat. No. 3,734,395 relates to such a bag.

SUMMARY OF THE INVENTION

The present invention provides a novel SOS bag which utilizes a tube with gussetted sides having a select pattern of adhesives applied on portions of the interior of the bag, near one end of the tube. The pattern is such that upon folding of the bag, a flat bottom is achieved which completely secures all interior flap edges.

To this end, in an embodiment, a flat-bottom bag is provided. The bag has a generally planar front wall, a generally planar rear wall substantially parallel to the front wall, and gussetted side walls connecting the front and rear walls. The bag has a bottom end folded to provide a flat bottom. The bottom has first and second flaps separated from the front and rear walls and folded over along fold lines. Adhesive is applied in edge regions along opposite edges of the front and rear walls from a bottom end of the tube toward an opposite end (top end) for a distance and applied in a strip across the front and rear walls connecting the edge regions. Adhesive is also applied along bottom edge regions of the side walls connecting said edge regions of the front and rear walls. Adhesive is also applied along bottom edge regions of the front and rear walls on either sides of the flaps.

In an embodiment, one adhesive can be printed and dried on the bag and then reactivated by heat.

In an embodiment, the adhesive is Heat Seal Polyvinyl Acetate.

In an embodiment, the adhesive is Heat Seal Polyvinyl Alcohol.

In a further embodiment, the bag material can include heat actuated adhesive applied over its entire inside surface and select regions can be heat activated for formation of the bag bottom. Advantageously, the bag can be made of a 100% heat sealable liner material. Heat can thus be applied to the select areas of the bag according to the invention to make the bag leak proof.

In an embodiment of the present invention, a flat-bottom bag is provided. The bag has a generally planar front wall, a generally planar rear wall which is substantially parallel to the front wall. There is a pair of adhesive patterns, one on an interior of the front wall and one on an interior of the rear wall. The bag further has a pair of gussetted side walls connecting said front and rear walls. A pair of flaps are provided. One first flap is separated from the front wall and the other flap extends from the rear wall.

An advantage of the present invention is to provide a bag that prevents objects contained therein from becoming entrapped under edges of a folded bottom.

A further advantage of the present invention is to provide a bag that has an efficient adhesive pattern that results in a beneficial sealing of a folded bottom.

Additional features and advantages of the present invention are described in, and will be apparent from, the detailed description of the presently preferred embodiments and from the drawings.

BRIEF DESCRIPTION OF THE DRAWINGS

FIG. 1 is a perspective view of an assembled bag of the present invention;

FIG. 2 shows the sack of FIG. 1 in a preliminary stage of construction;

FIG. 5 is a partial perspective view of the sack of FIG. 4 and a still further stage of construction;

FIG. 6 is a partial perspective view of the sack of FIG. 5 in a further stage of construction;

FIG. 7 is a sectional view taken generally along line VII—VII of FIG. 3;

FIG. 8 is a sectional view taken generally along line VIII—VIII of FIG. 4; and FIG. 9 is a sectional view taken generally along line IX—IX of FIG. 3.

DETAILED DESCRIPTION OF THE PREFERRED EMBODIMENTS

Figure 3:
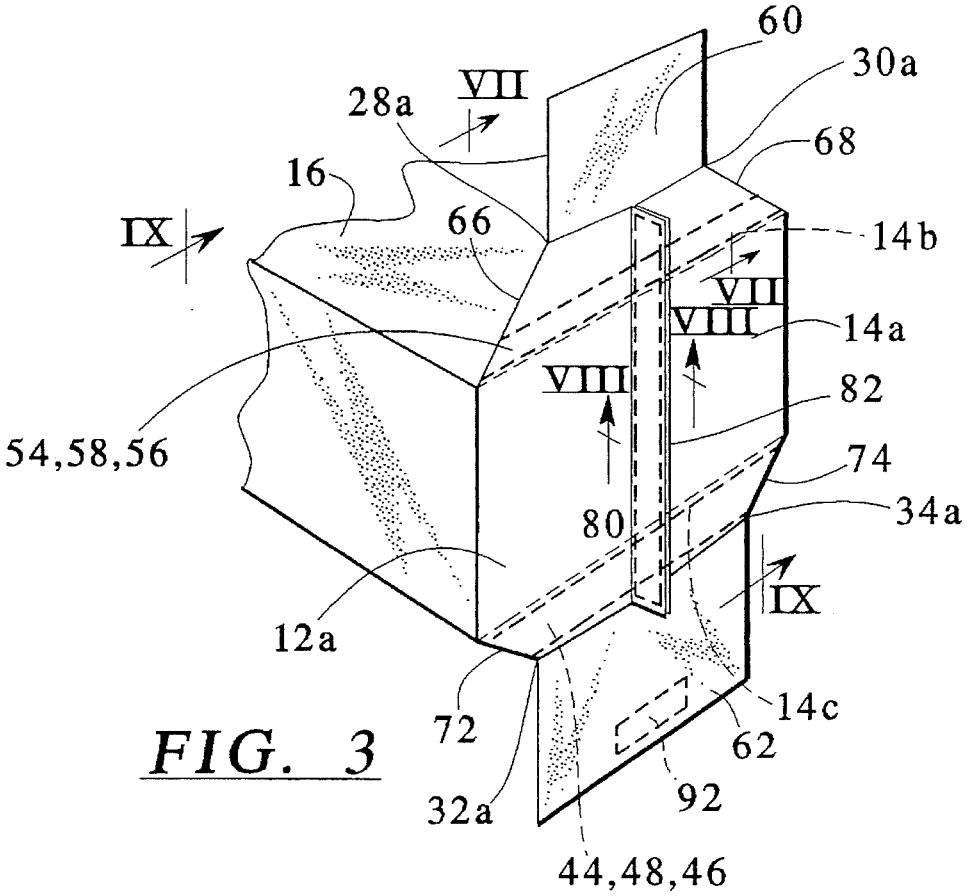
FIG. 3 is a partial perspective view of the bag of FIG. 2 in a further state of construction.

FIG. 1 illustrates a bag 10 having gusset left side wall 12 gussetted right side wall 14, front wall 16, and rear wall 18. The side walls, front wall, and rear wall are connected by a bottom structure 20 at one end and forms an open top 22 opposite thereto.

FIG. 2 illustrates the bag in an unassembled state comprising a tubular member 24 having a bottom open end 26 which provides slits 28, 30 proceeding axially from the bottom 26 through the front wall 16. Two additional slits 32, 34 are cut through the rear wall 18. A bottom region B of the front wall 16, rear wall 18 and side walls 12, 14 is utilized for creating the bottom structure 20. Strips of adhesive such as heat actuated adhesive are applied on inside surfaces of the front and rear panel 16, 18 and the side panels 12, 14. Alternately, the entire inside surface of the bag can be a heat sealable liner material and the liner material can be selectively heat actuated in the specific regions described below.

Side edge strips 36, 38 are applied along the bottom end 26 on the side panels 12, 14 respectively. Applied on the rear panel 18 are front strips 40, 42 respectively which extend from the side panels 12, 14 to the slits 32, 34. Edge strips 44, 46 are applied on the bottom panel 18 along the side panels 12, 14 respectively. A transverse strip 48 is applied at a distance from and parallel to the open end 26 and which connects the edge strips 44, 46 respectively. The transverse strip 48 is applied along a transverse fold line 49.

A similar arrangement of adhesive strips is applied to the front panel 16 including front strips 50, 52, edge strips 54, 56, and transverse strip 58 connecting the edge strips 54, 56 and applied along a transverse fold line 59. The slits 28, 30 create a front flap 60 and the strips 32, 34 create a rear flap 62. The front flap 60 has a narrower width than the rear flap 62 and the slits 30, 28 extend axially from the bottom end 26 a shorter distance than the slits 32, 34.

As illustrated in FIG. 3, to assemble the bottom structure 20, cross folds 66, 68 are made in the top panel 16 extending from opposite ends of the transverse fold line 59 to terminal points 28*a*, 30*a* of the slits 28, 30, respectively. A portion 12*a* of the left side panel 12 is folded perpendicular to the panel 12 to form one half of the bottom closure. Likewise, an end portion 14*a* of the right side panel 14 is folded perpendicularly to form a second half for the bottom closure. The rear panel 18 is likewise folded in the bottom region B to a terminal 32*a* 34*a* of the slits 32, 34 resulting in fold 72, 74.

A strip 80, folded off from the side wall 12 and the front wall 16 and the rear wall 18 into a single plane member, faces a corresponding strip 82 folded off from the front wall 16, the side wall 14 and the rear wall 18. When these strips are folded and pressed together the adhesive regions 50, 36, 40 and 52, 38, 42 are pressed together. Additionally, the strips 54, 58 and 56 are pressed and sealed together as are the strips 44, 48 and 46 pressed and sealed together. The adhesive strips can be sealed together upon application of heat.

Heat actuated adhesive is advantageous in that the adhesive used is not "sticky" or "tacky" during the folding operation and is effectively rendered "sticky" only at elevated temperature. Thus, not only during folding are the adhesive strips non-sticky, but any exposed adhesive after heating and cool down returns to a non-sticky or non-tacky state. This avoids objects adhering to bag surfaces.

Figure 4:
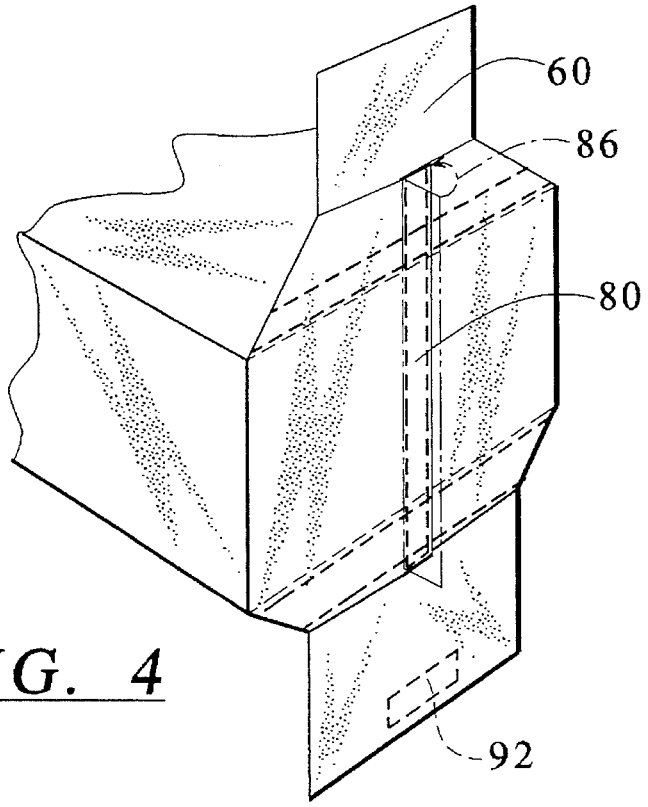
FIG. 4 is a partial perspective view of the sack of FIG. 3 in a further stage of construction.

As shown in FIG. 4 the strips 80, 82 are rotated in the direction 86 to be folded flat against the panel 14a. As illustrated in FIG. 5 the top flap 60 is then folded down into the direction 90 to press flat against this strip 80. As shown in FIG. 6 the rear flap 62 is then folded up into the direction 92. A rear flap adhesive region 92, which can be a heat actuated adhesive or a glue or paste, can be used for securement, or the entire rear flap 62 can be heat sealed with an adhesive over the front flap 60.

The inside surface of the bottom structure 20 thus has folded side edges 100, 102; sealed front and rear edges 104, 106; and a sealed center seam 108. Thus, trapping of small articles beneath loose flaps is avoided.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A bag comprising:

a tubular body having a front wall, a rear wall and left and right side walls connecting said front and rear wall to form a rectangular cross section, and a bottom wall formed from left and right folded over portions of said left and right side wall respectively, said portions of said left and right side wall adhesively attached to said front and rear walls along the width of said front and rear walls at fold lines between said front wall and said bottom wall and between said rear wall and said bottom wall, and front and rear flaps cut from said front and rear walls to overlie said left and right folded over portions forming said bottom wall and adhesively secured thereto;

said left and right folded over portions are adhesively secured together along a seam therebetween extending perpendicularly to said front wall; and wherein said seam comprises two planar strips formed of bottom edges of said left and right side walls and contiguous portions of said front and rear walls folded perpendicularly from said left and right folded over portions respectively adhesively glued along their entire length and folded over to lay flat against one of said folded over portions.

2. A tube with adhesive regions for assembling into a bag comprising:

a front wall, a rear wall, a left side wall and a right side wall connected in a rectangular tube having an open top and an open bottom;

adjacent said open bottom said front and rear walls having parallel slits extending from said open bottom lengthwise for a first and second distance respectively; and adhesive applied to an inside surface of said front wall along bottom edge regions of said front wall adjacent said open bottom from said slits outwardly to said side walls, and along front wall edge regions of said front wall along and contiguous with said side walls said front wall edge regions arranged perpendicularly to said bottom edge regions of said front wall and extending longitudinally to a third distance greater than said first distance and along a front wall transverse region extending perpendicularly from said front wall edge regions inwardly connecting said front wall edge regions; and adhesive applied to an inside surface of said rear wall along bottom edge regions of said rear wall from said slits outwardly to said side walls, and along rear wall edge regions of said rear wall along and continuous with said side walls said rear edge regions arranged perpendicularly to said bottom edge regions of said rear wall and extending longitudinally to a fourth distance greater than said second distance and along a rear wall transverse region extending perpendicularly from said rear wall edge regions inwardly connecting said rear wall edge regions.

3. The tube according to claim 2, further comprising adhesive applied to side regions extending on both said side walls from said front wall to said rear wall adjacent said open bottom of said tube.

4. The tube according to claim 2, wherein said adhesive comprises a heat actuated adhesive.

5. The tube according to claim 4, wherein said heat actuated adhesive is applied over an entire inside surface of said tube from said open bottom to at least said third distance.

* * * * *

UNITED STATES PATENT AND TRADEMARK OFFICE

CERTIFICATE OF CORRECTION

PATENT NO. : 5,518,316
DATED : May 21, 1996
INVENTOR(S) : Jay L. Kristola

It is certified that error appears in the above-indentified patent and that said Letters Patent is hereby corrected as shown below:

Column 4, line 44, "continuous" should be -- contiguous --

Signed and Sealed this

First Day of April, 1997

Bruce Lehman

*Attest:*

BRUCE LEHMAN

*Attesting Officer*

*Commissioner of Patents and Trademarks*